United States Patent [19]

McCall et al.

[11] Patent Number: 4,874,263

[45] Date of Patent: Oct. 17, 1989

[54] TWO BY ONE TWILL WEAVE FOR AN IMPRESSION FABRIC

[76] Inventors: Jones McCall, 105 ½ Sunset Dr.; Tom McClure, 102-D Yester Oaks, West; Letcher Monroe, 2904 Stratford Dr., all of Greensboro, N.C. 27405

[21] Appl. No.: 285,364

[22] Filed: Dec. 15, 1988

Related U.S. Application Data

[63] Continuation of Ser. No. 869,708, Jun. 2, 1986, abandoned.

[51] Int. Cl.[4] ..... B41J 31/02

[52] U.S. Cl. ..... 400/241.3; 139/426 R; 400/196.1

[58] Field of Search ..... 400/194, 195, 196, 196.1, 400/237, 241, 241.1, 241.2, 241.3; 139/426 R, 426 TW

[56] References Cited

PUBLICATIONS

"Woven Cloth Construction", Robinson et al, published 1973 by the Textile Institute, Manchester, England, pp. 106–107.

*Primary Examiner*—Ernest T. Wright, Jr.

*Attorney, Agent, or Firm*—Nixon & Vanderhye

[57] ABSTRACT

A two by one twill fabric optimized for use in an impression type fabric is disclosed. This 2×1 twill weave has improved ink retention characteristics without a corresponding loss in impression quality. The fabric may be used for any conventional impression fabric application, including printer cartridges.

24 Claims, 3 Drawing Sheets

TWO BY ONE TWILL WEAVE FOR AN IMPRESSION FABRIC

This is a continuation of application Ser. No. 06/869,708, filed June 2, 1986, now abandoned.

FIELD OF THE INVENTION

This invention relates to a weave to be used in producing an impression-type fabric. More specifically, this invention relates to a two by one twill weave to be used in a fabric for a printing tape or the like.

BACKGROUND OF THE INVENTION

Weaving has been known for many years. Due to the highly specialized nature of the field, there are certain definitions which will be set forth herein for proper understanding of the invention.

FIG. 1 shows a typical plain weave pattern 100. In this plain weave, there are a first plurality of substantially parallel yarn pieces which are all perpendicular to a second plurality of substantially parallel yarn pieces. The first yarn pieces such as 102 are known in the trade as warp yarn. This yarn 102 is in the loom at the time when the weaving is accomplished. The second yarn pieces, as exemplified by 104, are the fill or weft yarn. This yarn 104 is inserted across the warp yarns 102 to form the weave pattern. The weave is formed as a diagonal—that is each particular type of intersection of warp and weft yarns 102, 104 is repeated at a diagonal to the previous intersection. For instance, intersection 106 has the warp yarn 110 above the weft yarn 112 or warp over weft. Therefore, intersection 108, at a diagonal to intersection n106, has this same characteristic (warp over weft).

The ends per weave repeat is the number of warp yarns (also called "ends") which exist in one pattern. For instance, if FIG. 1 were to be considered as a single pattern in the weave, the ends per weave for this structure would equal 3.

Denier is a term which is used specifically in synthetic-type fabrics, such as nylon and polyester. In these synthetic fabrics, the yarns are composed of filaments. This can be seen with reference to FIG. 2 which shows a plurality of filaments 120, 122 in yarn 124. The denier is a measure of usually the weight in grams of 9000 meters of a yarn. Typically, filament yarns are also specified by the number of filaments making up the yarn. However, for present purposes, denier will be expressed in yarns per pound.

Traditionally, in impression printing tape, a one by one plain weave of dense construction has been used to obtain a material with a maximal amount of ink holding characteristics. A twill weave has not been used for this purpose.

It is desirable to have a large amount of ink stored in the material to minimize the frequency of ribbon changing. One way to do this is to "open" the weave, providing large interstices between yarns to serve as ink reservoirs. Another way is to add layers of ink to the fabric surface. However, as the amount of yarn per square inch is reduced, a critical point is reached at which the clarity of the print which can be obtained from this fabric suffers. However, as a limiting factor, there is only a standard clearance between the paper to be imprinted and the impact mechanism in which this material is located, typically, 5/10,000 of an inch. Therefore, the inked fabric cannot merely be thickened to increase its printing clarity or its ink retention. Therefore, what has been needed in the art is a material which has maintained the same properties of print clarity and has increased ink retention per square inch and per unit thickness.

SUMMARY OF THE INVENTION

In order to improve the above-mentioned characteristics, a two by one twill weave is herein described which has great advantages of ink retention and construction. A twill weave is a weave that repeats on three or more ends and picks and defines diagonal lines on the face of the cloth. By using the two by one twill weave defined herein, advantageous ink retention characteristics are obtained.

BRIEF DESCRIPTION OF THE DRAWINGS

An exemplary and presently preferred embodiment of the invention will be described in detail with reference to the accompanying drawings wherein.

DESCRIPTION OF THE PRESENTLY PREFERRED EXEMPLARY EMBODIMENT

Figure 1:
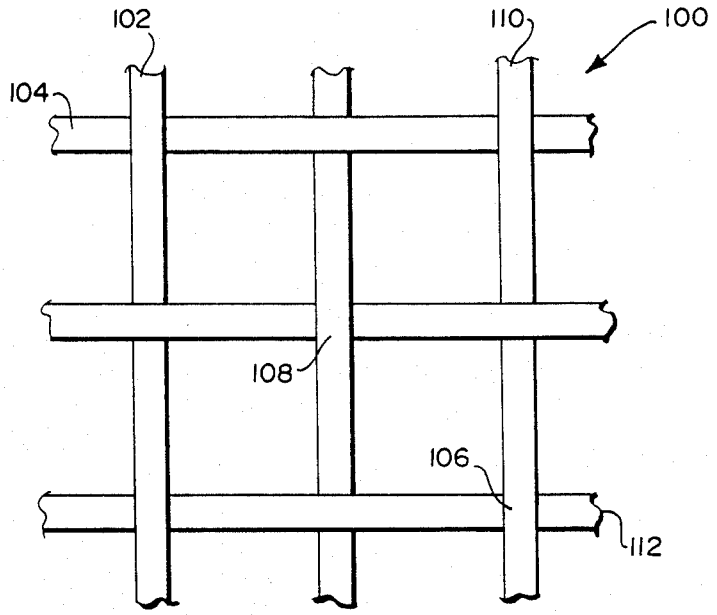
FIG. 1 (PRIOR ART)
FIG. 1 shows a plain weave.
Figure 2:
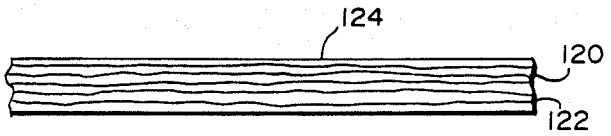
FIG. 2 (PRIOR ART)
FIG. 2 shows a single strand of yarn with filaments therein.

An embodiment of this invention will be discussed herein with reference to the Figures. As has been discussed above, the typical typewriter or printer ribbon has used a 1 x 1 plain weave of dense construction. Such a weave is illustrated in FIG. 1 which represents prior art. This weave has proven to be useful, however better results have been obtained by the weave according to the present invention which will be discussed herein.

Figure 4:
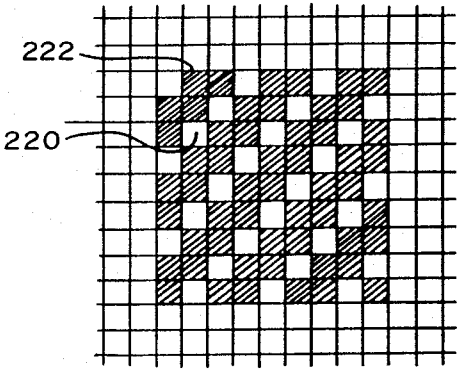
Figure 3:
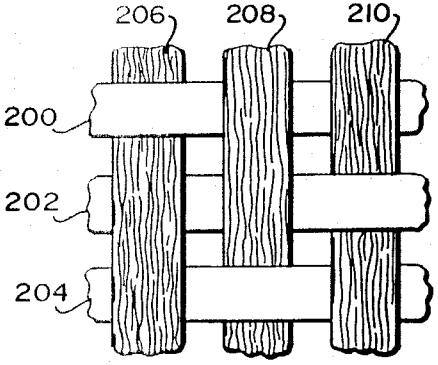
FIG. 3 shows the technical face side of a fabric according to an embodiment of the present invention.

FIG. 3 shows the technical face side of an embodiment of such a weave. This figure shows a twill weave of the two by one type. In this specific weave, a plurality of filling yarns 200, 202 and 204 are shown. Warp yarns 206, 208 and 210 are also shown. Fill yarn 200 can be seen as disposed under two warp yarns 210 and 208 and over warp yarn 206. This specific pattern is twilled—that is alternately moved so that no two adjacent filling yarns have a same over-under pattern. A diagrammatic embodiment of the pattern can be seen in FIGS. 4 and 5 where a filling yarn over a warp yarn is shown as a white square 220 and a filling yarn under a warp yarn as a black square 222. As can be seen in FIG. 4, the repetitions of a filling yarn under two warp yarns in a fabric is staggered and moves upward and to the right.

Figure 5:
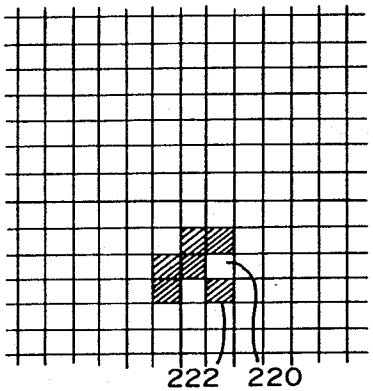
FIGS. 4 and 5 show this technical face side in a graphical form.

FIG. 5 shows this same type of diagram for the single pattern shown in FIG. 3.

Figure 8:
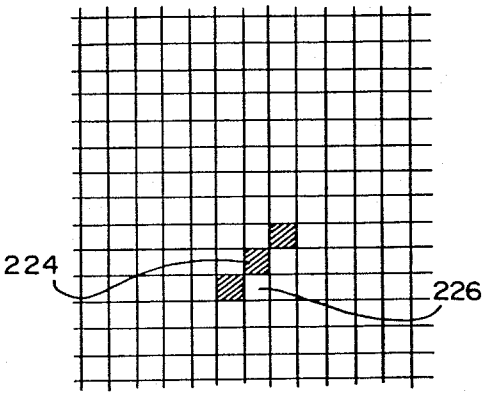
FIGS. 7 and 8 show the technical back side in graphical form.
Figure 7:
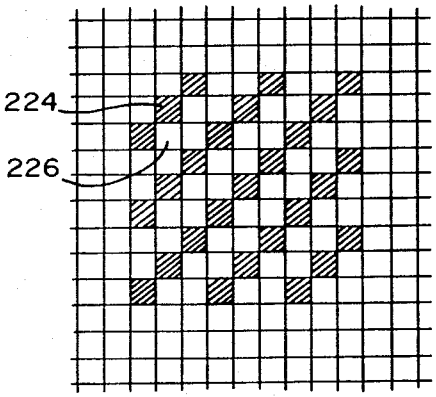
Figure 6:
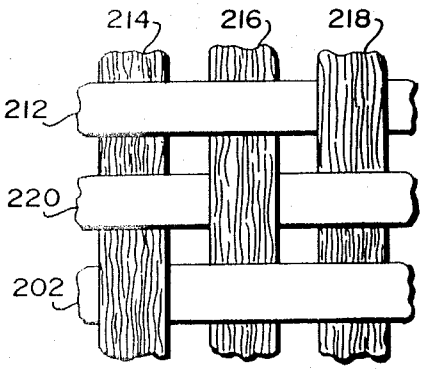
FIG. 6 shows the technical back side of the embodiment of the present invention.

The technical back side of the fabric according to this invention is shown in FIGS. 6, 7 and 8. This includes a weft of filling yarn 212 disposed over two warp yarns 214 and 216 and under a third warp yarn 218. However, filling yarn 220 is disposed over warp yarn 214, under warp yarn 216, and over warp yarn 218. Accordingly, filling yarn 220 has an inverted pattern to filling yarn 204 of FIG. 3, and is adjacent to a yarn which has an inverted pattern to FIG. 3's filling yarn 200. Similarly, filling yarn 222 is disposed under warp yarn 214 and over two warp yarns 216 and 218. As can be seen in FIG. 7 (in which, from the perspective of the technical back side, a warp yarn crossing over a filling yarn is denominated by a black square 224 and a warp yarn under a filling yarn is shown by a white square 226), the pattern of a filling yarn overlying two warp yarns moves upward and to the right. FIG. 8 shows the pattern of FIG. 6 in this same diagrammatic form.

Figure 9:
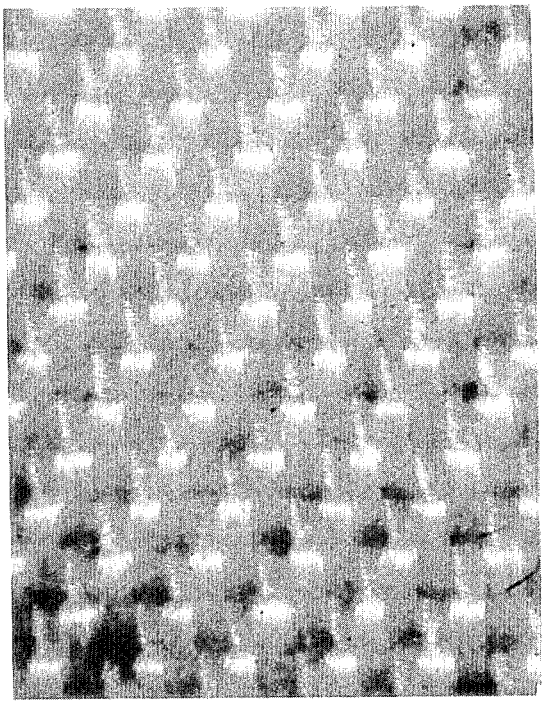
FIG. 9 shows a front view of the fabric as constructed according to the present invention.
Figure 10:
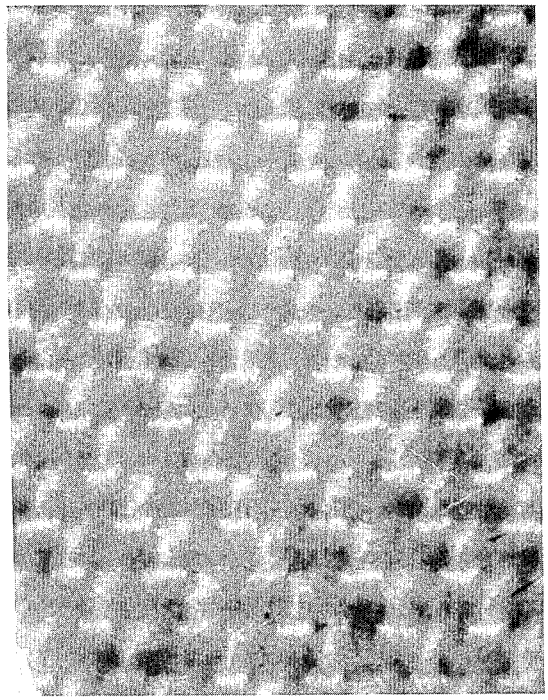
FIG. 10 shows a back view of such fabric.

Photographs of the fabric are shown in FIGS. 9 and 10. FIG. 9 shows a front view of this fabric and FIG. 10 shows a back view.

The theoretical maximum set of TMS for the yarn can be calculated using the following formulae;

$$\underset{\text{(Warp)}}{TMS} = \frac{\sqrt{\text{(Den. in yds./lb.)}} \times \text{(ends/weave repeat)} \times \text{(.95 cover factor)}}{\text{(Ends/weave repeat)} + \text{(no. of interlacings)}}$$

$$\underset{\text{(Fill)}}{TMS} = \frac{\sqrt{\text{(Den. in yds./lb.)}} \times \text{(picks/weave repeat)} \times \text{(.95 cover factor)}}{\text{(Picks/weave repeat)} + \text{(no. of interlacings)}}$$

Therefore: TMS (warp & fill)=TMS (warp)+TMS (fill)

In order to obtain maximum performance, including greater capillarity for printing inks, as well as the ability to mechanically contain the ink until released through impact, the fabric is further enhanced after weaving by finishing under specially controlled tensions and temperatures, so that a warp wise yarn crimp exceeds the weft wise crimp by a ratio of greater than 1.2 to 1. It is well within the level of ordinary skill in the art to select such tensions and temperatures.

In order to obtain the best quality of printing material, the inventors have found that the following loom ratios should be observed. The warp range ratio should be between 0.50 and 0.60. The fill range ratio should be between 0.50 and 0.60. The inventors have also determined that an optimal warp to fill ratio is 60/40, but that 55/45 is also a very workable number. The loom ratio of warp to filling should be within the range of 60/40 to 50/50.

An example of an advantageous material constructed according to the present invention will now be discussed.

(1) Type weave: 2×1 Right-hand warp will (twill line runs from bottom left to top right)

(2) Finished twill angle: 55° Steep twill (a steep twill will have twill angles more than 45°)

(3) Warp yarn: 40 denier, 34 filament, "0" twist, nylon 6,6

(4) Filling yarn: 40 denier, 34 filament, "0" twist, Nylon 6,6

(5) Construction in loom: Theoretical maximum set construction at 60×40.

$\underset{\text{(Warp)}}{TMS}$ = 190 ends per inch $\underset{\text{(Fill)}}{TMS}$ = 190 picks per inch $\underset{\text{(warp \& fill)}}{TMS}$ = 380

Therefore:
*TMS* (*w* & *f*) × 60% = in loom sley (loom sley=how many ends in the loom per inch)
380 × .60 = 228 sley ends per inch
*TMS* (*w* & *f*) × 40% – In loom picks
380 × .40 = 152 picks (6) Construction after preparation and heat set:
Finish sley=244.5±2 ends per inch
Finish picks=158.0±2 ends per inch
(7) Weight after preparation and heat set:
Finish weight=2.24± oz/sq. yd.
(8) Thickness after heat set:
Finish caliper=0.0053±0.0002 inches The material constructed as discussed above has a larger capillarity in both warp and fill directions, as well as faster capillarity in these directions. There is a higher percentage of ink holding capacity within the interstices between the yarn filaments. A longer print life can be obtained using the same percentage of ink normally placed in a plain weave ribbon. In addition, a longer print life can be further obtained since the 2×1 twill ribbon when saturated holds more ink than a saturated plain weave ribbon. A plain weave ribbon woven from 40 denier yarn typically has a theoretical maximum set of 360 ends per inch. However, the 2 by 1 twill fabric allows a higher theoretical maximum set of up to 400 ends per inch. This relatively high theoretical maximum set could not be obtained in a plainweave ribbon.

Furthermore, the 2×1 twill ribbon has stronger ultrasonic welding strength, stronger tensile strength in both warp and fill directions, stronger tear strength in both warp and fill directions, higher resistance to abrasion and produces print quality comparable to conventional ribbon formed of plain weave fabric.

Figure 11:
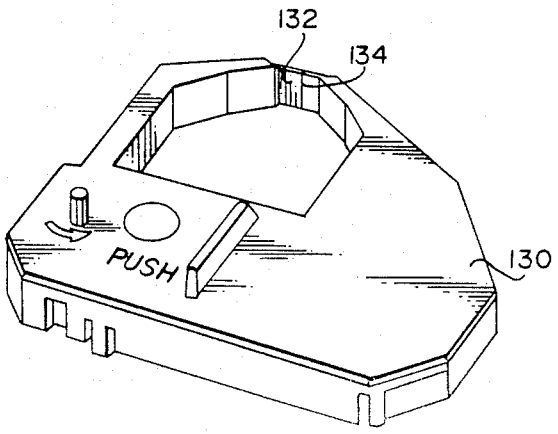
FIG. 11 shows a printer cartridge having a ribbon made of such fabric.

The finished fabric may then be slit to an appropriate width, inked, cut to length and incorporated into printer ribbon cartridges, or typewriter ribbon spools or the like, such as the cartridge 130 shown in FIG. 11. In forming printer cartridges, the ribbon is joined to itself in an endless loop by an ultrasonic weld. FIG. 11 illustrates the ribbon 132 which is formed in an endless loop and packed into the cartridge 130 in conventional fashion. An ultrasonic weld is illustrated in exaggerated form at 134 and is also conventional.

Although only a few exemplary embodiments of this invention have been described in detail above, those skilled in the art will readily appreciate that many modifications are possible in the exemplary embodiments without materially departing from the novel teachings and advantages of this invention. For instance, the TMS may be proportionally reduced by as much as 12.5% in the warp and fill direction, while using the same size yarn as originally calculated in the TMS, still obtaining the advantageous structure and advantages recited above. In some instances the set could be as much as 25% below the theoretical maximum. Nylon yarn denier can range from about 10 to about 70 denier and still maintain satisfactory results. Other nylons besides nylon 6,6 and polyester can be used. Also twisted yarns may be used, with twists of up to eight turns per inch (or perhaps more) expected to be desirable. Accordingly, all such modifications are intended to be included within the scope of this invention as defined in the following claims.

What is claimed is:

1. An impression printing tape constructed of fabric comprising a plurality of synthetic yarns interlaced with one another in a two by one twill weave, and wherein ink applied to the fabric is stored within interstices formed between the interlaced synthetic yarns.

2. A fabric as in claim 1 wherein the loom ratio of warp to fill is within the range of 60/40 to 50/50.

3. A fabric as in claim 1 in which said yarns are 40 denier yarns and having 190 to 228 warp ends per inch.

4. A fabric as in claim 1 in which said yarns are 40 denier yarns and having 152 to 190 picks per inch.

5. A fabric as in claim 4 in which said yarns are 40 denier, and having 190 to 228 warp ends per inch.

6. A fabric as in claim 1 finished to achieve a warp-wise yarn crimp to weft-wise yarn crimp ratio of greater than 1.2 to 1.

7. A fabric as in claim 1 wherein said synthetic yarns are all nylon.

8. An impression fabric for use in printing devices comprising:

a plurality of warp yarns of a synthetic material of a denier of between about 10 and about 70 substantially parallel to one another;

a plurality of weft yarns of a synthetic material of a denier between about 10 and about 70 substantially perpendicular to said warp yarns and parallel to one another, each said weft yarn being interlaced with a plurality of said warp yarns, and traversing two of said warp yarns on one side of said fabric before interlacing to the other side of said fabric, then traversing one said warp yarn on said other side and interlacing to said one side, adjacent ones of said weft yarns traversing two warp yarns in a staggered fashion.

9. A fabric as in claim 8 wherein the loom ratio of warp to fill is within the range of 60/40 to 50/50.

10. A fabric as in claim 8 woven at a set of from 75 to 100% of maximum theoretical set.

11. A fabric as claimed in claim 8 woven at a set of from 87.5 to 100% of maximum theoretical set.

12. A fabric as in claim 8 wherein said yarns are all formed of nylon.

13. An impression fabric consisting of woven synthetic yarns in a 2×1 twill pattern at a set of 75 to 100% of theoretical maximum set, said fabric finished to achieve weft-wise yarn crimp ratio of greater than 1.2 to 1.

14. A fabric as in claim 13 wherein said synthetic yarns are nylon.

15. An impression fabric consisting of woven synthetic yarns in a 2×1 twill pattern at a set of 87.5 to 100% of theoretical maximum set.

16. An impression fabric as claimed in claim 15 saturated with ink.

17. A fabric as claimed in claim 15 in which the yarns which the fabric is woven have no twist.

18. A fabric as claimed in claim 15 in which the yarn of which the fabric is woven have up to eight turns per inch of twist.

19. A fabric as in claim 15 wherein said synthetic yarns are all nylon.

20. A ribbon cartridge for an electronic printer or typewriter having a ribbon, formed of all synthetic yarns, and formed as a 2×1 twill woven fabric, and wherein ink applied to said ribbon is stored within interstices formed between said yarns.

21. A cartridge as claimed in claim 20 in which said ribbon is woven at 87.5 to 100% of theoretical maximum set.

22. A cartridge as claimed in claim 21 wherein said ribbon is saturated with ink.

23. A cartridge as claimed in claim 20 in which the ribbon is joined to itself in an endless loop by an ultrasonic weld.

24. A fabric as in claim 20 wherein said synthetic yarns are nylon.

* * * * *